United States Patent [19]

Capraro

[11] Patent Number: 5,036,779

[45] Date of Patent: Aug. 6, 1991

[54] AUTOMATIC TELLER MACHINE ENCLOSURE

[76] Inventor: Tony Capraro, 178 Pierce St., Staten Island, N.Y. 10304

[21] Appl. No.: 512,916

[22] Filed: Apr. 23, 1990

[51] Int. Cl.[5] ..... G07G 5/00; E08B 7/32

[52] U.S. Cl. ..... 109/24.1; 109/2; 109/73

[58] Field of Search ..... 109/24.1, 2, 48, 57, 109/73, 5, 7, 11; 902/25

[56] References Cited

U.S. PATENT DOCUMENTS 4,513,670 4/1985 Berman ..... 109/24.1

4,577,562 3/1986 Berman ..... 109/24.1

4,813,475 5/1989 Couvrette ..... 109/24.1

*Primary Examiner*—Robert L. Wolfe

*Attorney, Agent, or Firm*—Richard L. Miller

[57] ABSTRACT

An enclosure having a front portion and a rear portion houses an automatic teller machine, which is mounted in one wall of said front portion and provides access to customers via a cut out in said front wall. The rear wall of the front portion is open. The rear portion has an open front wall and a door in one side thereof. The rear portion is mounted on wheels and slides to enable it to be nested within the front portion, or to be extended from the front portion to enable service access to the inside of the enclosure via the door.

2 Claims, 3 Drawing Sheets

AUTOMATIC TELLER MACHINE ENCLOSURE

BACKGROUND OF THE INVENTION

1. Field of the Invention

This invention relates to an enclosure for housing an automatic teller machine comprising a pair of telescoping sections which expand from their nested position to provide a structure sufficiently large to be entered by service personnel, and which takes up minimum room when nested.

2. Description of the Prior Art

Automatic unmanned teller machines are common in today's society. Such machines are commonly located away from the principal banking offices, such as in lobbies, airports, shopping centers or installed in and accessible from an outside wall of a bank building. Most of such machines have 24 hour walk-up or drive-up availability, and the machines must be secure from access by unauthorized persons both from the outside where the automated banking is performed by the public and from the inside where the mechanisms of the machine and usually cash are located.

In addition to availability and security, another factor in the location for such machines is that they take up as little space as possible. When installed on an outside wall of a bank building it is important that the machine be accessible for servicing, but if its security enclosure extends too far into the banking premises, it takes away from room otherwise available for bank workers. When the machine is being serviced it is also necessary that such servicing take place in a secure environment. All these factors are possible if the housing for such machines comprises a pair of telescoping sections, one of which fits within the other, with access into the enclosure being possible only when the two sections of the enclosure are unmeshed or separated from the intermeshed or nested position.

An expandable security structure for housing an automatic teller machine comprising a pair of telescoping sections that nest together is shown in Hastings U.S. Pat. No. 4,121,523 and to Stine U.S. Pat. No. 4,244,302, but neither of these references have the simplicity of the present invention.

It is an object of the present invention to provide a secure enclosure for housing an automatic teller machine in which a pair of telescoping sections expand from a nested position which takes up a minimum of space to an expanded position where access is possible into the enclosure for servicing.

Another object of this invention is an expandable security structure containing an automatic teller machine in which the teller machine is accessible for use by the public but is secure from tampering and theft when in its closed position.

A further object of this invention is an expandable security structure for housing an automatic teller machine in which one portion is easily movable between a nested position for security and an expanded position for servicing.

SUMMARY OF THE INVENTION

In accordance with the present invention an enclosure houses an automatic teller machine commonly referred to by the acronym ATM which is accessible to customers from outside the enclosure. The enclosure consists of a substantially cubic front portion with a roof and side walls and containing the ATM in the front wall with the opposite wall being open, and a cubic rear portion slightly narrower than the front portion having a top and side walls, a rear wall and an open front, the side walls being spaced apart slightly less than the side walls of the front portion, the rear portion being slidable into the front portion for nesting therewith by means of mechanical slides connected to the inside of the side walls of the front portion and the outside of the side walls of the rear portion.

The rear portion contains a hinged door in one side wall permitting access into the enclosure when the rear portion is removed from its nested position and extended to its rearmost stop position. Upon nesting there is formed a small roomlike enclosure for the ATM inaccessible from outside.

Wheels are mounted on the bottom of the rear portion bearing most of the weight of the rear portion and also permitting it to be moved easily into and out of its nested position. A keyed deadlock is built into one side of the rearmost wall of the rear portion and meshes with a pin or other retaining means in the abutting sidewall of the front portion to prevent undesired separation of the enclosure from its nested position unless the lock is unlatched with a key.

BRIEF DESCRIPTION OF THE DRAWING FIGURES

The figures in the drawings are briefly described as follows.

BRIEF DESCRIPTION OF THE PREFERRED EMBODIMENT

Figure 1:
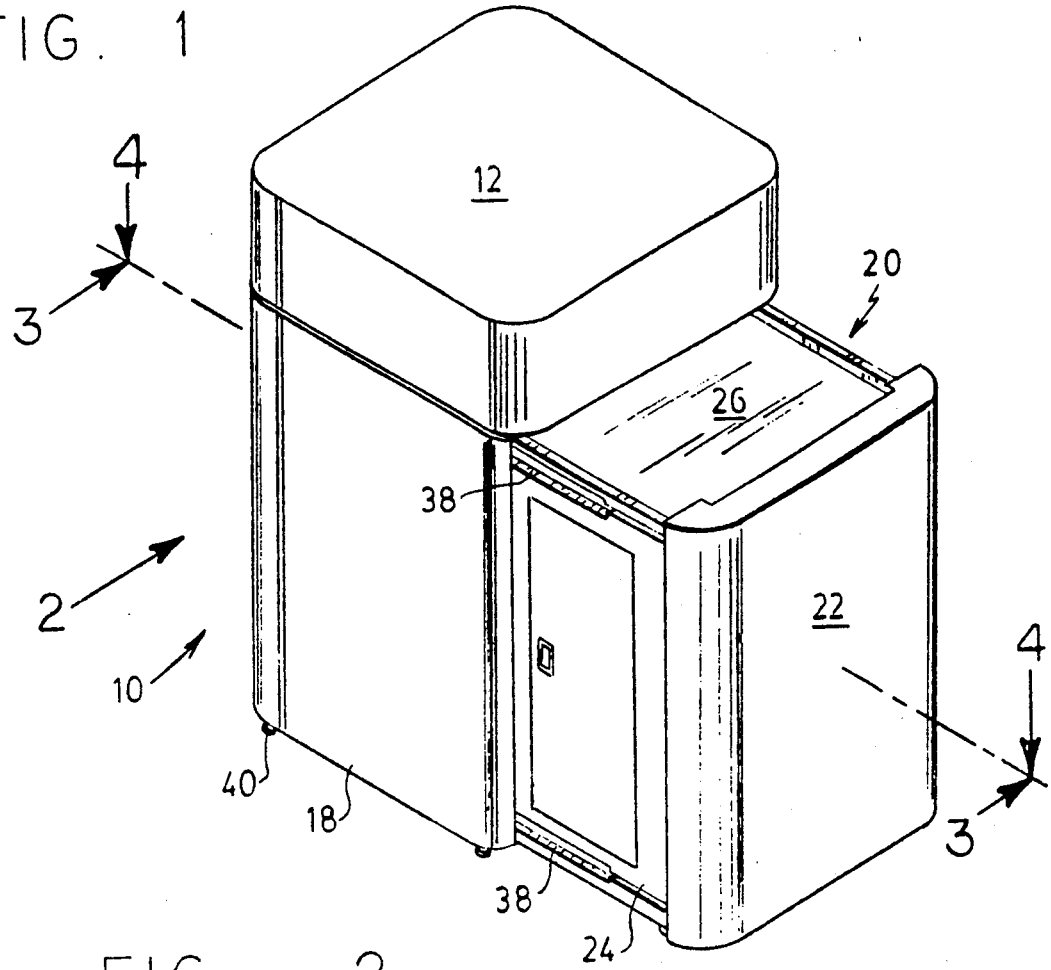
FIG. 1 is a perspective view of the invention in an expanded position.
Figure 2:
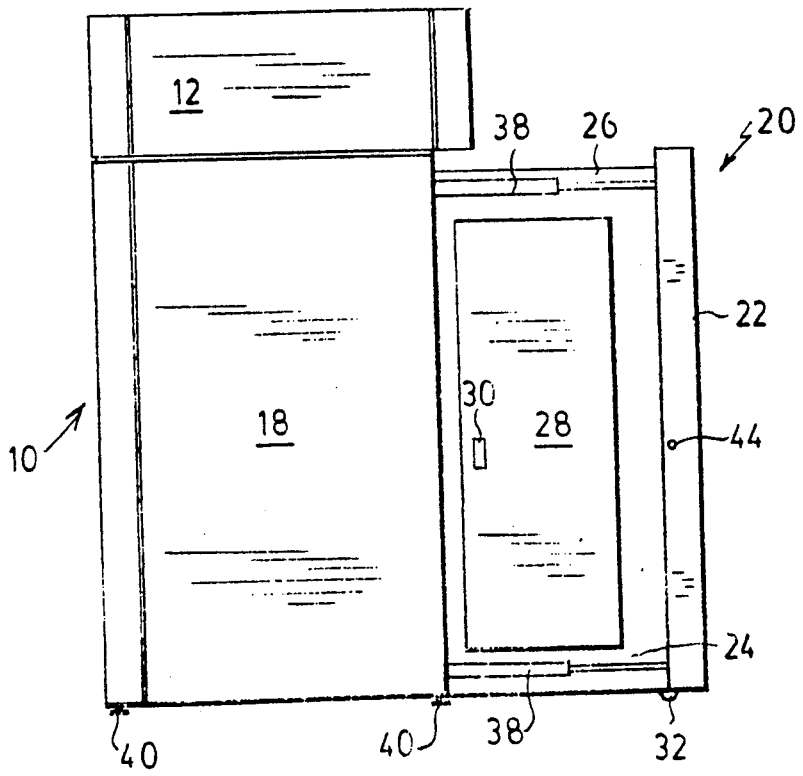
FIG. 2 is a front elevation taken in the direction of arrow 2 of FIG. 1.

The Figures show the enclosure which comprises a substantially cubic front portion 10 and a slightly smaller cubic rear portion 20. Front portion 10 has cap-like roof 12. An automatic teller machine ATM 14, not visible in FIGS. 1 and 2, is supported within the front wall 16 of portion 10 and is accessible for use by customers from the outside of the enclosure. Sidewalls 18 extend from both ends of front wall 16 at right angles thereto. The rear or back side of portion is open.

A rear portion 20 with a back wall 22, side walls 24 and a flat top 26 is similar in size to front portion 10 but slightly narrower between side walls 24 so that the entire rear portion 20 will fit within front portion 10 except for rear wall 22 which extends slightly beyond the point of attachment of walls 24 on each side, the extensions abutting the rearmost extension of side walls 18 to form a closed rear wall for the enclosure when it is in its nested position with portion 20 within portion 10.

A door 28 having a pull 20 attached to and flush therewith is built into one side wall 24 and hinged so as to open inwardly whereby entry to the enclosure is possible when the rear portion 20 is pulled away from its nested position within front portion 10. Wheels or casters 32 are mounted to an L-shaped bracket 34 which is in turn bolted to an inner support wall 36 attached to a lateral frame member, not shown attached to rear wall 22. A pair of full extension slide members 38 are attached on the inside of side walls 18 and to the outside of side walls 24 on both sides of the enclosure, the slides 38 permitting smooth movement of rear portion 20 into and out of front portion 10.

Front portion 10 is mounted on adjustable leveling feet 40, and is preferably bolted to the floor by screw bolts passed through corners 42 fixedly attached at the bottom corners of front portion 10.

Flooring may be used in either or both portions 10 and 20, but may add unnecessary weight to the enclosure. Exterior walls are preferably constructed from wood and/or FORMICA®, and laminate composite materials have sufficient strength to withstand numerous moves of the enclosure and the forces of the nesting/unnesting movement while being light in weight and strong enough to resist attempts to enter the enclosure by unauthorized people. The portion of the enclosure open to access by the public may requite additional strengthening.

To prevent unauthorized entry into or movement of the enclosure, rear portion 20 is secured to front portion 10 by a deadbolt lock 44 attached within one of the extensions of the wall 22 and which engages a clasp or the like attached to or within a wall 18 adjacent to wall 22, the lock requiring a key to enable the rear portion 20 to be moved relative to front portion 10. Although not shown, pulls may be attached at a convenient place on the rear wall 22 to conveniently permit one person to push or pull rear portion relative to front portion 10.

When the enclosure is fully opened, door 28 may be opened and entered by service personnel to service the ATM. Approximate dimensions for the fully nested enclosure are 5' by 5' with a height of 8', and for the expanded enclosure 5' by 8' by 8'. With such dimensions it is possible for three persons to service the ATM from inside the enclosure. Electrical power is supplied to the enclosure for the ATM and may also be used for interior lighting and for supplying power to service equipment.

Figure 3:
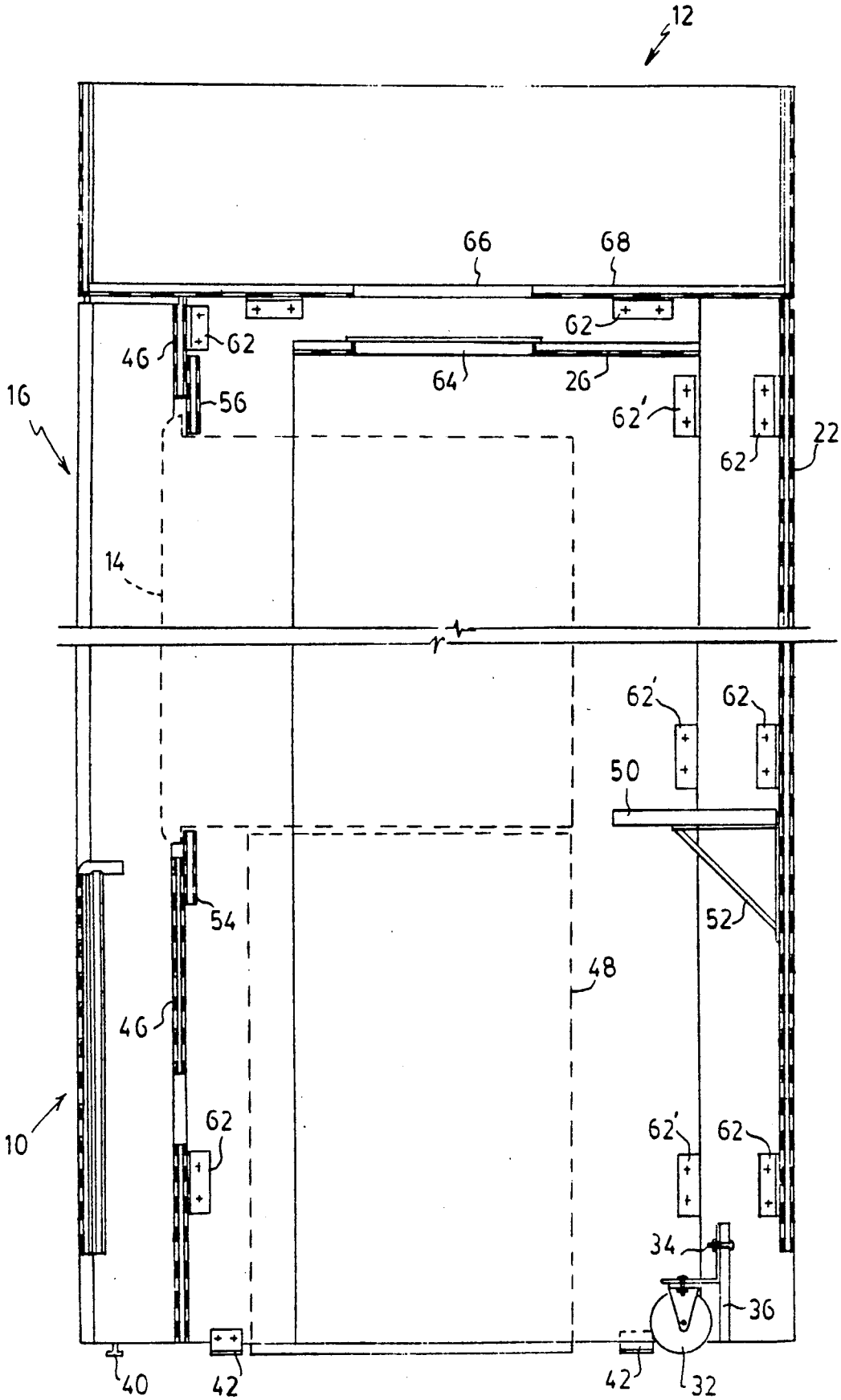
FIG. 3 is a cross sectional view taken along line 3—3 of FIG. 1 but with the enclosure in its nested position.

FIG. 3 shows a preferred construction for the enclosure. Front wall 16 has a cut-out to permit mounting of ATM 14. The ATM 14 is supported on an inner wall 46 which also contains a central cut out and bears the weight of ATM 14. Internal support for the ATM is shown by dotted lines 48, which may consist of a cabinet with rearward facing shelves for storing records and/or test equipment, as well as providing support for the ATM.

Mounted on the inside of rear wall 22 is a shelf 50 which may be mounted on hinges, not shown, and supported by a locking hinged bar 52 to enable service personnel to keep their equipment within reach inside the enclosure. Inner supporting walls 54 and 56 are connected to inner wall 46 such as by bolts which enable walls 54 and 56 to be adjusted and/or removed to permit mounting of and access to ATM 14. Similar vertical supporting walls 58 and 60 are bolted to inner wall 46.

Support for the outer walls is provided by lightweight aluminum beams 62 attached horizontally to the inside of the walls as shown in FIG. 3. The enclosure also has a wire mesh grille 64 in top wall 26 immediately beneath a vented opening 66 which may comprise a pipe which extends completely through top 12 permitting heat generated by the ATM to escape from the enclosure.

Figure 4:
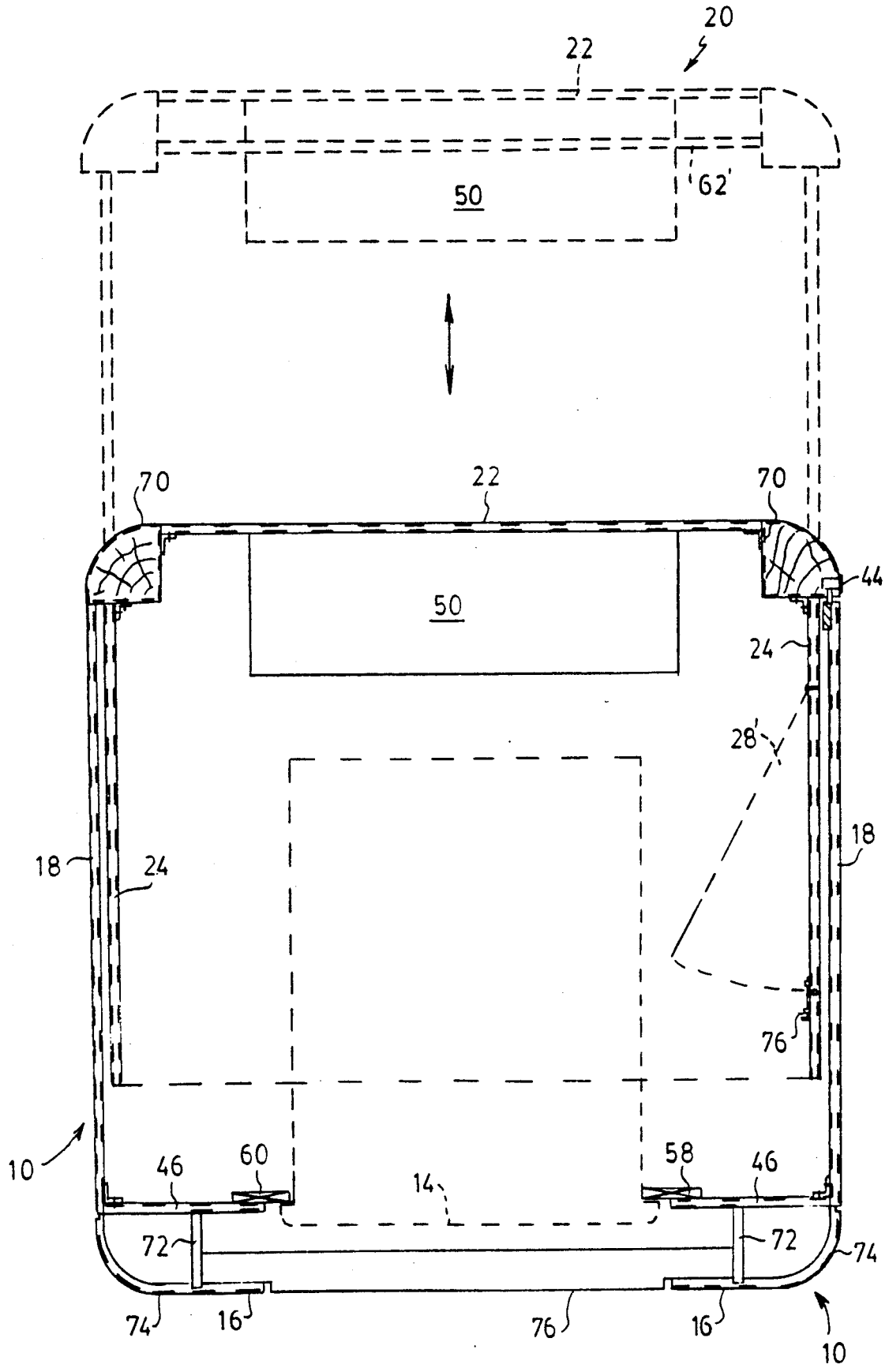
FIG. 4 is a cross sectional view taken along line 4—4 of FIG. 1.

As seen best in FIG. 4, lightweight metallic or wooden quarter round pieces 70 may be attached to rear wall 22 and side walls 24 such as by bolts and/or brackets to provide added support to rear portion 20. Also shown in phantom at 62' is a lightweight metal beam connected between quarter round pieces 70 for added support. Phantom lines 28' shows door 28 in its open position. In front portion 10 are shown beams 72 extending vertically to connect support wall 46 with front wall 16. Corner pieces 74 of about 5" radius are used to connect side walls 18 and front wall 16 to provide support and a finished appearance.

A bullet catch 76 is shown connected to maintain door 28 closed un il it is unlatched.

FIG. 4 shows in phantom the rear portion 20 pulled away from its nested position. To expand the enclosure, deadlock 44 is unlocked and the rear portion is pulled backwards and rolls on wheels 32 until the end of slides 38 are reached. Stops may also be attached to walls 18 and/or 24 to provide a fixed stop when rear portion 20 is pulled away from its nested position. A shelf 76 may also be attached under ATM 14 for the convenience of users.

While the invention has been described with respect to its preferred embodiment, it is apparent that changes may be made to the construction and arrangement of parts without departing from the scope of the invention as hereinafter claimed.

What is claimed is:

1. An expandable enclosure for an automatic teller machine comprising:

a) a front portion having a vertical front wall, a pair of side walls extending at right angles from the opposite ends of said front wall, and a top covering said front portion, the wall of said front portion opposite said front wall being fully open;

b) a rear portion having a rear wall, a pair of side walls extending at right angles from said rear wall slightly inward from the ends of said rear wall, and a top covering said rear portion, the wall of said rear portion opposite said rear wall being open and the distance between said rear portion side walls being less than the distance between said front portion side walls;

c) a hinged door located in one of the rear portion side walls;

d) wheel means located at the bottom of said rear portion adjacent said rear portion rear wall;

e) a pair of slides having stops attached to the inside of each front portion side wall and to the outside of each rear portion side wall whereby said rear portion is adapted to fit within said front portion with the part of the rear wall of said rear portion outside the side wall thereof abutting the open ends of the side walls of said front portion and whereby a closed enclosure structure is formed, said rear portion being adapted to be translated rearwardly relative to said front portion an amount sufficient to expand said enclosure and permit access thereto via said door, the walls of said front and said back portions overlapping sufficiently to prevent access into said enclosure via said door except when said rear portion is translated to its maximum unnested position; and f) locking means connected with said front and back portions for preventing undesired separation of said portions from said nested position; and g) an opening in the top of said rear portion, and a vent in the top of said front portion aligned with said opening when said enclosure is in its nested position wherein the top of said rear portion is drawn clear of the vent in the top of said front portion when said rear portion is translated to its maximum unnested position.

2. An enclosure as in claim 1 and including a latch means for opening said door, and pull means for said door mounted flush therewith.

* * * * *